US007857288B2

(12) United States Patent
Dunlap

(10) Patent No.: US 7,857,288 B2
(45) Date of Patent: Dec. 28, 2010

(54) AIR CONDITIONER COMPRESSOR REMOVAL AND INSTALLATION APPARATUS

(76) Inventor: Jason E. Dunlap, 417 Bristol Rd., Walnut Shade, MO (US) 65771

( * ) Notice: Subject to any disclaimer, the term of this patent is extended or adjusted under 35 U.S.C. 154(b) by 0 days.

(21) Appl. No.: 12/292,616

(22) Filed: Nov. 21, 2008

(65) Prior Publication Data

US 2010/0127227 A1 May 27, 2010

(51) Int. Cl.
*B66D 1/00* (2006.01)

(52) U.S. Cl. ..... 254/324; 254/332; 254/325

(58) Field of Classification Search ..... 254/324, 254/329, 332, 325
See application file for complete search history.

(56) References Cited

U.S. PATENT DOCUMENTS

| | | | | |
|---|---|---|---|---|
| 2,465,289 | A | 3/1949 | Sitton | |
| 2,896,891 | A | 7/1959 | Ernst | |
| 3,178,143 | A | 4/1965 | Gustin | |
| 3,503,390 | A | 3/1970 | Peters | |
| 3,524,606 | A * | 8/1970 | Coski | 242/484.2 |
| 4,468,004 | A * | 8/1984 | Shaver et al. | 254/325 |
| 5,090,507 | A | 2/1992 | Olson et al. | |
| 5,150,768 | A | 9/1992 | Olson et al. | |
| 5,284,324 | A | 2/1994 | Bunger | |
| 5,975,499 | A * | 11/1999 | Ostrobrod | 254/332 |
| 6,056,273 | A | 5/2000 | Smith | |
| 6,092,790 | A * | 7/2000 | Dobmeier et al. | 254/323 |
| 6,854,537 | B2 | 2/2005 | Weholt | |
| 7,063,006 | B1 | 6/2006 | Spehle et al. | |
| 7,165,795 | B2 | 1/2007 | Williams | |
| 7,182,318 | B1 * | 2/2007 | Crabtree | 254/324 |
| 7,311,297 | B1 * | 12/2007 | Bradshaw et al. | 254/272 |

OTHER PUBLICATIONS

Website, http://www.beacontechnology.com/gantrycranes/tripodhoiststand/, tripod hoist with adjustable height legs, one sheet printed from the internet on May 6, 2008.

Website, http://www.hoistsdirect.com/wallace_tripod_crane.htm, tripod crane, two sheets printed from the internet on May 6, 2008.

* cited by examiner

*Primary Examiner*—Emmanuel M Marcelo
(74) *Attorney, Agent, or Firm*—Richard C. Litman

(57) ABSTRACT

The air conditioner compressor removal and installation apparatus includes an upper plate having multiple sets of leg sockets depending therefrom. The distal ends of legs installed within any given set of sockets subtend a circle corresponding to the diameter of the inner rim of an air conditioner, heat pump, or HVAC coil housing. The distal end of each leg includes an inverted, L-shaped shoe that rests upon the inner rim of the coil housing when the apparatus is placed thereon. The upper plate includes a winch having a winch cable extending through a hole in the plate. The compressor within the coil housing is disconnected from its attachment and electrical and refrigerant lines. The apparatus is placed atop the coil housing. The winch cable is connected to the compressor, and the winch is operated to lift the compressor from within the coil housing. The process is reversed for reinstallation.

18 Claims, 3 Drawing Sheets

AIR CONDITIONER COMPRESSOR REMOVAL AND INSTALLATION APPARATUS

BACKGROUND OF THE INVENTION

1. Field of the Invention

The present invention relates generally to tools and equipment used in the heating, ventilating, and air conditioning industry, and particularly to an air conditioner compressor removal and installation apparatus that facilitates the removal and installation of an air conditioner or heat pump compressor from or into its installed location within the coil housing of an air conditioner or heat pump installation.

2. Description of the Related Art

Air conditioner and heat pump units conventionally house the compressor within the evaporator or condenser coils of the unit, in order to provide a compact installation. From time to time it may be necessary to remove the compressor from its installed location within the coil housing for maintenance, repair, or replacement, as required. This is accomplished conventionally by disconnecting the electrical and refrigerant lines at the compressor, unbolting the compressor from its base within the coil housing, and manually lifting the compressor from within the coil housing. This is obviously a strenuous task, requiring two workers to lift the compressor from such a relatively inaccessible location. Air conditioner and heat pump compressors are rather heavy components when configured for typical household or small business installations, and their bulk and weight, in combination with the relatively tight quarters of their typical installation, results in an extremely awkward process when manually removing or installing such a compressor.

Thus, an air conditioner compressor removal and installation apparatus solving the aforementioned problems is desired.

SUMMARY OF THE INVENTION

The air conditioner compressor removal and installation apparatus comprises an upper plate having at least one set of leg sockets depending therefrom. Preferably at least two, and more preferably three, sets of leg sockets are provided, with each set having at least three sockets arranged in a circular pattern about the underside of the upper plate. Each set is installed about a different circular diameter from the other(s) so that the distal ends of the installed legs subtend different diameter circles, depending upon the set of sockets in which they are installed. The provision of multiple sets of leg installation sockets provides versatility for the apparatus, allowing the apparatus to form a tripod with different leg spans for use with air conditioner, heat pump, or HVAC (heating, ventilation, and air conditioning) units of different sizes.

Each of the legs includes a distal shoe or foot having an inverted L-shaped configuration, with one flange facing downwardly and outwardly. The other flange is substantially horizontal and rests upon the upper surface or cover of the air conditioner coil housing when the legs are installed within the upper plate sockets and the apparatus is installed atop the coil housing, with the downwardly extending flange being generally vertical and fitting closely within the inner rim of the upper opening of the air conditioner coil housing. A padded liner and/or material having a relatively high coefficient of friction (e.g., a rubberized coating, etc.) may be applied to the coil housing contact surfaces of the shoes to avoid marring the finish of the top cover of the coil housing.

A winch is installed atop the upper plate. A cable extends from the winch through a hole or passage in the upper plate.

The winch may be hand-operated, or may be electrically, pneumatically, or hydraulically powered, as desired. The cable includes a hook or other suitable attachment at its distal end. The hook is attached directly or indirectly to the compressor once the apparatus has been installed atop the coil housing of the air conditioner unit. At this point the winch is actuated to lift the previously disconnected compressor from its site within the coil housing until the base of the compressor is above the top of the coil housing. A board, plank, or other suitable rest is placed across the coil housing, and the compressor is lowered to rest upon the board or plank and disconnected from the winch cable of the apparatus. At this point the apparatus may be removed temporarily to facilitate removal of the compressor for repair or replacement. The repaired compressor, or its replacement, is placed upon the rest surface atop the coil housing, the apparatus is reinstalled atop the coil housing, and the process is reversed to reinstall the compressor.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
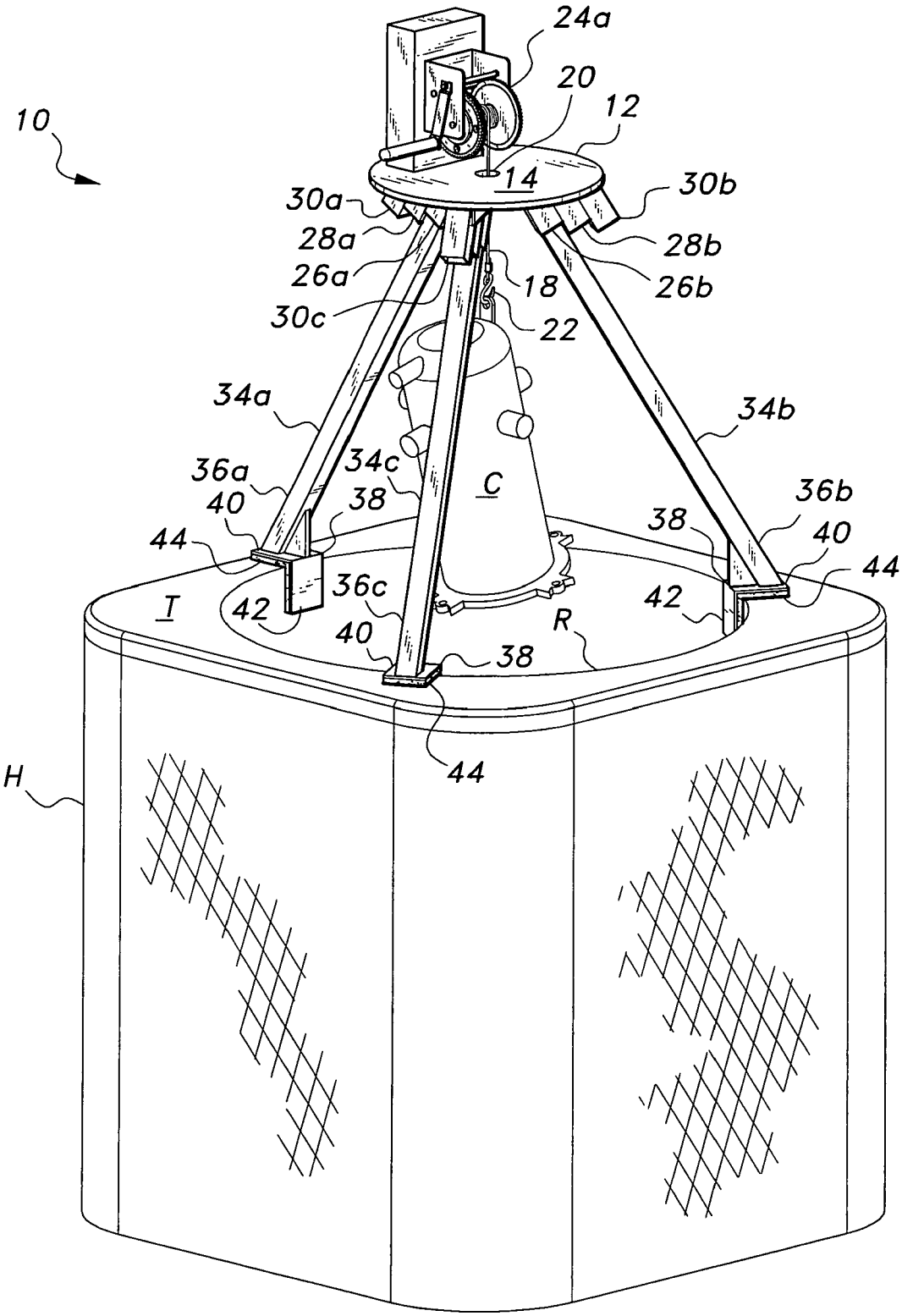
FIG. 1 is an environmental, perspective view of an air conditioner compressor removal and installation apparatus according to the present invention, showing its use and operation.

The present invention is an apparatus that is removably installable atop an air conditioning or heat pump coil housing for removal and installation of the refrigerant compressor from its installed location within the coil housing. FIG. 1 provides a general environmental view of a first embodiment of the apparatus 10 placed atop the refrigerant coil housing H of an air conditioner or heat pump installation for lifting the compressor C therefrom, or for lowering the compressor C therein. The apparatus 10 generally forms a tripod and a winch mounted on a platform atop the tripod. The apparatus includes an upper platform or plate 12 having an upper surface 14 and an opposite lower surface 16 (shown in FIG. 3). The plate 12 may be circular or any other practicable shape, as desired.

A winch 24*a* is installed atop the upper surface 14 of the plate 12. A cable 18 (or rope or other flexible line having sufficient strength) retractably extends from the winch 24*a* through a winch cable hole or passage 20 formed through the plate 12. A hook 22 or other suitable means for temporarily attaching the distal end of the cable 18 to the compressor C (air conditioning or heat pump compressors are conventionally provided with an eye or lifting lug that the hook 22 can attach to) is provided, the hook 22 extending from the distal end of the cable 18. A hand-operated winch 24*a* is illustrated atop the apparatus 10 of FIG. 1, with an alternative electrically powered winch 24*b* shown installed atop the apparatus 10 of FIG. 2.

Figure 2:
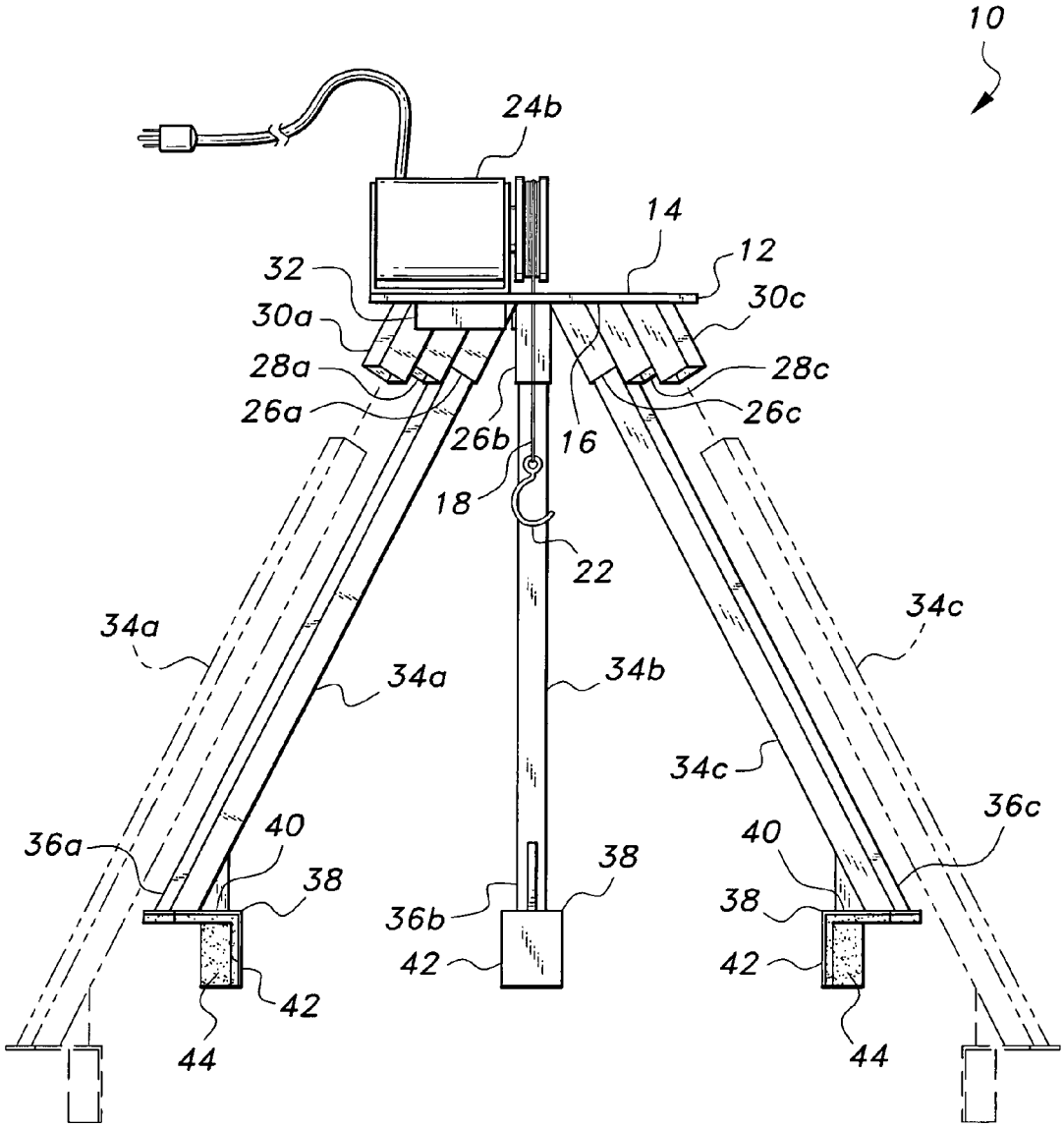
FIG. 2 is a side elevation view of a second embodiment of an air conditioner compressor removal and installation apparatus according to the present invention, including an electric winch.

It will be recognized that the principle of operation of the winch is not critical and that any conventional type of winch may be installed atop the upper platform or plate 12 of the apparatus 10, including, e.g., a conventional pneumatically or hydraulically powered winch. Preferably, the electric winch 24*b* shown in FIG. 2 is provided, as electrical power is generally readily available at most sites where air conditioners or heat pumps are installed. In the event that no on-site electrical power is available, such an electric winch 24*b* may be powered by a portable generator brought to the site, or, alternatively, a pneumatic or hydraulic winch may be powered by a suitable power unit brought to the site along with the apparatus 10 and other tools and equipment conventionally required for the job.

Figure 3:
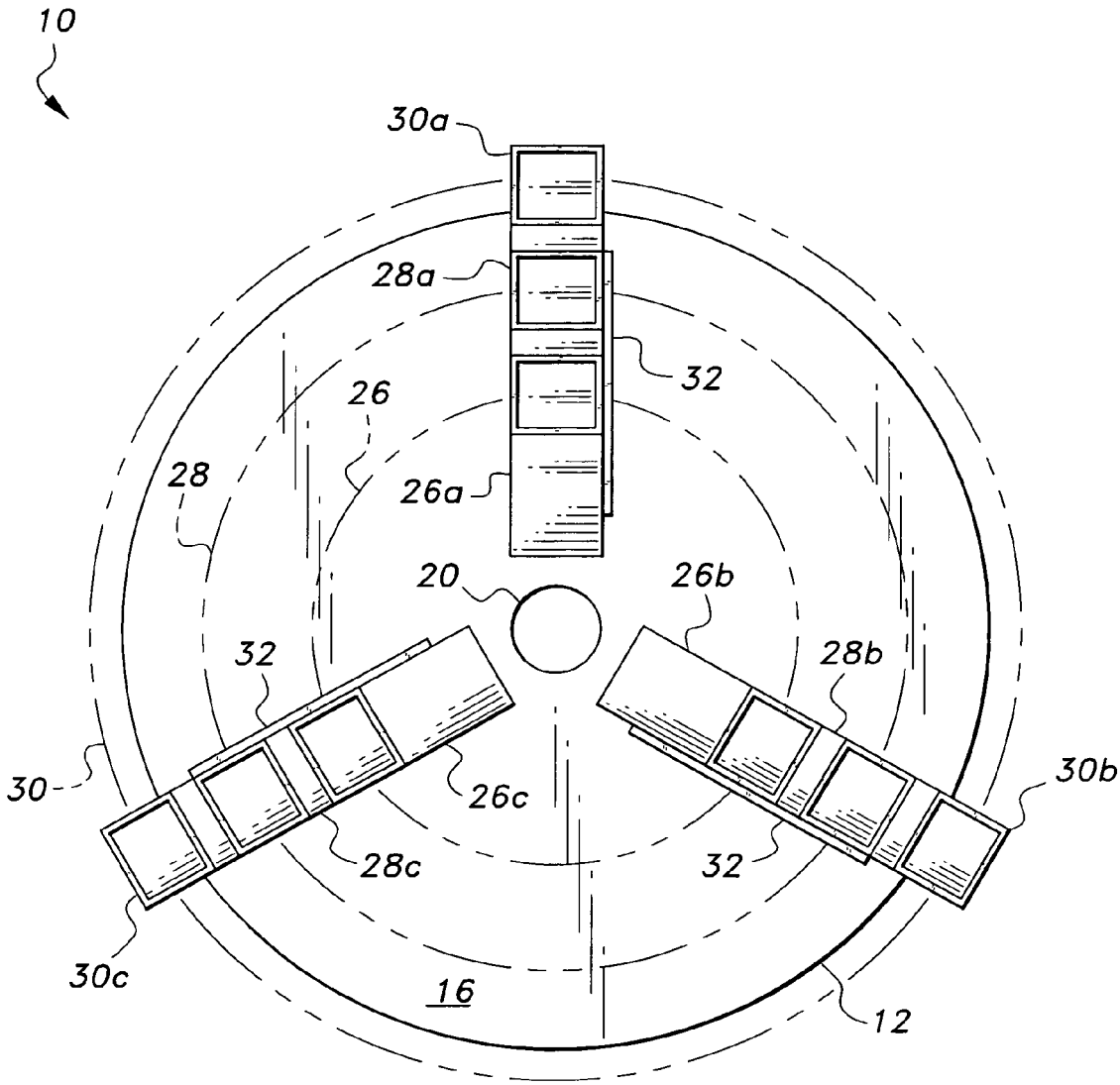
FIG. 3 is a bottom plan view of the upper platform of the apparatus of either FIG. 1 or FIG. 2, showing the multiple circumferential rows of leg installation sockets extending therefrom.

A plurality of leg sockets extends from the lower surface of the plate 12. FIG. 3 of the drawings provides the clearest view of an exemplary arrangement of the leg sockets. The leg sockets are arrayed in groups, with each group defining a leg socket circle. Although the apparatus 10 may be provided with simply a tripod with fixed legs attached directly to the upper platform 12, and be furnished in different sizes with tripods having different leg spans to accommodate different compressor models, preferably, the apparatus 10 has at least two circular groups of leg sockets, and more preferably, three such groups, in order to position have a single apparatus 10 that provides a tripod with a user selectable leg span to fit different sizes of air conditioner or heat pump coil housings, as required. Only a single set or circular group of leg sockets may be provided if the apparatus 10 is to be used with only a single size of coil housing.

In FIG. 3, a first or inner leg socket circular group 26 comprises three legs 26*a*, 26*b*, and 26*c*. A second or medial leg socket group 28 includes three legs 28*a*, 28*b*, and 28*c*, with a third or outer circular leg socket group 30 comprising leg sockets 30*a*, 30*b*, and 30*c*. Each of the leg sockets 26*a* through 30*c* defines an acute angle (i.e., somewhat less than 90°) with the lower surface 16 of the plate 12, as shown in FIGS. 1 and 2. The angles of each of the leg sockets in a given group are the same in order to provide a stable installation for the apparatus 10. In the leg socket configuration shown in FIGS. 1 through 3, the adjacent leg socket sets of the three groups 26 through 30, e.g., leg sockets 26*a*, 28*a*, and 30*a*, are closely spaced together (welded, etc.) and parallel to one another, thus forming identical acute angles with the lower surface 16 of the plate 12. Additional reinforcement may be provided by a side gusset 32 welded or otherwise affixed to the sides of each immediately adjacent set of sockets, e.g., sockets 26*a*, 28*a*, and 30*a*, as shown in FIGS. 2 and 3.

It will be seen that the different diameters of the three leg socket circles 26 through 30 will dictate the diameters of the circles defined by the distal ends of the apparatus legs when installed in any given leg socket group, with the diameters of the distal leg end circles differing by the same dimensions as the differences between the leg socket circles 26 through 30 due to the parallel configuration of immediately adjacent leg sockets as described above. However, the leg sockets of each circle 26 through 30 may be set at differing angles to one another, if so desired, with the leg sockets of any given circle (e.g., sockets 30*a*, 30*b*, and 30*c* of the outer circle 30) all forming identical angles with the plate 12. More sockets may be provided in each group, but preferably three such sockets are provided in each group, with a corresponding number of legs forming a tripod configuration for the apparatus 10 when installed.

It will be noted that the sockets are preferably fixed to the upper plate 12, rather than being pivotally attached to the upper plate 12 to allow continuous adjustment of the diameter of the circle subtended by the legs. Pivotal attachment of the legs to the upper plate might potentially result in accidental collapse or failure of the tripod when the pivotal joints are stressed with the load of the compressor C. The fixed sockets provide the apparatus 12 with a rigid structure to withstand the load, while multiple circles of sockets permit the apparatus 10 to be used with coil housings of different size. However, a tripod with legs pivotally attached to the upper plate 12 may be used, if desired.

A plurality of legs is provided, with the number of legs equal to the number of leg sockets in any given circle. In the example of FIGS. 1 through 3, three such legs 34*a*, 34*b*, and 34*c* are provided for removable installation in the corresponding sockets of the desired leg socket circle, e.g., the inner circle sockets 26*a*, 26*b*, and 26*c* as shown in FIG. 1. As the sockets in any given circle are essentially identical, and the legs 34*a* through 34*c* are essentially identical, any of the legs may be installed interchangeably in any of the sockets of a given leg socket circle as desired. As the legs are in compression when the apparatus 10 is installed and in use, it is not necessary to provide any positive retaining means for securing the legs in their respective sockets. However, such retaining means (e.g., drilled holes and quick release pins, etc.) may be provided, if so desired.

FIG. 2 also illustrates the repositioning of the legs, e.g., first and third legs 34*a* and 34*c*, from the innermost sockets 26*a*, 26*c* to the outermost sockets 30*a*, 30*c*. The legs 34*a*, 34*c* are shown in solid lines for their installation in the innermost sockets 26*a*, 26*c*, and in broken lines for their alternative installation in the outermost sockets 30*a*, 30*c*. It will be noted that any given leg, e.g., first leg 34*a*, forms the same angle relative to the plate 12 regardless of which socket (e.g., 26*a*, 26*b*, or 26*c*) in which it is installed. Thus, the spacing of the lower or distal ends 36*a*, 36*b*, 36*c* of the legs when interchanged between immediately adjacent sockets is identical to the difference in the diameters of the leg socket circles 26, 28, and 30. This allows the legs 34*a* through 34*c* to be installed in the sockets of a given leg socket circle according to the required span or diameter of the distal ends of the legs, which is determined by the diameter of the inner rim R of the coil housing H, as shown in FIG. 1.

The distal end 36*a* through 36*c* of each of the legs 34*a* through 34*c* has a shoe 38 extending therefrom. Each shoe is rigidly and immovably affixed to its respective leg distal end, e.g., welded, etc. Each of the shoes 38 has an inverted, L-shaped configuration, with the included angle of the upper flange 40 and the depending flange 42 of the shoe 38 facing downwardly and outwardly when the legs 34*a* through 34*c* are properly installed in the desired leg sockets. The two flanges 40 and 42 are shown most clearly in FIG. 2 of the drawings. When the legs 34*a* through 34*c* are properly installed within the appropriate sockets 26*a* through 30*c*, the horizontally disposed upper flanges 40 of each shoe 38 rest atop the top cover T of the coil housing H, with the vertically depending flanges 42 of each shoe 38 extending downwardly to fit immediately inside the inner rim R of the coil housing H. Each of the shoes 38 preferably includes a padded liner 44 of soft and/or resilient material disposed upon the included angle of the shoe 38, i.e., the coil cover contact surfaces, to avoid marring the finish of the coil housing top cover T.

The apparatus 10 is used to remove or replace a compressor within the coil housing of an air conditioner or heat pump unit by initially removing the guard or screen conventionally installed across the upper opening of the coil housing H to access the compressor C. The refrigerant and electrical lines are disconnected from the compressor and the compressor is unbolted from its base attachment within the coil housing H.

At this point, the legs 34*a* through 34*c* are installed in the appropriate leg sockets 26*a* through 30*c* of the apparatus 10 as required, depending upon the diameter of the inner rim R of the top cover T of the coil housing H. The appropriate leg socket circle 26, 28, or 30 is selected to position the shoes 40 to fit properly along the inner rim R of the top cover T. The completed tripod comprising the upper plate 12 and legs 34*a* through 34*c* depending therefrom is placed atop the coil housing H, with the shoes 38 at the distal ends 36*a* through 36*c* of the legs resting along the rim R of the top cover T of the coil housing. The winch cable 18 is extended from its winch 24*a*, 24*b*, etc. (depending upon the type of winch installed), and connected to the compressor C by the conventional lifting eye or lug provided on the compressor, or other suitable temporary attachment means. The winch is then actuated to lift the compressor C from within the coil housing H to a position above the top cover T of the coil housing H. At this point a board, plank, or the like may be placed temporarily across the top of the coil housing H, beneath the compressor. The compressor C is lowered to rest atop the board or plank, the lift cable 18 disconnected from the compressor, and the apparatus 10 removed from the top of the coil housing H. The compressor C is thus readily accessible for repair or removal as desired.

The above-described process is essentially reversed for the reinstallation of the repaired compressor or installation of a different compressor, as required. The apparatus 10 thus greatly reduces the physical labor involved in handling the relatively heavy and bulky compressor, particularly eliminating the need for workers to reach downwardly into the compressor housing H to lift the heavy and bulky compressor therefrom. Such conventional compressor removal and reinstallation not only requires a fair amount of physical strength, but great coordination as well, as the maneuvering space is limited within the coil housing and the coils themselves are relatively delicate and subject to damage if inadvertently bumped by the compressor. The air conditioning compressor removal and installation apparatus greatly reduces or eliminates this potential hazard, greatly simplifying the compressor removal and installation process for those involved.

It is to be understood that the present invention is not limited to the embodiments described above, but encompasses any and all embodiments within the scope of the following claims.

I claim:

1. An HVAC compressor removal and installation apparatus, comprising:

an upper plate having an upper surface and a lower surface opposite the upper surface;

a winch mounted on the upper plate, the winch being adapted for lifting and lowering the compressor;

a plurality of groups of leg sockets extending from the lower surface of the plate, each of the leg sockets defining an angle between the socket and the lower surface of the plate, each of the groups defining a leg socket circle, each leg socket circle having a different diameter from one another, the leg sockets within each leg socket circle defining identical angles to one another; and a plurality of legs removably installed within the leg sockets and corresponding in number to the leg sockets of one of the groups of leg sockets.

2. The HVAC compressor removal and installation apparatus according to claim 1, further comprising an inverted L-shaped shoe extending from each of the legs, each shoe having an upper flange adapted for resting atop a cover of a compressor coil housing, wherein the housing includes an inner rim, and a downwardly extending flange adapted for placement immediately within an inner rim of the compressor coil housing, said upper plate, said leg sockets, said legs, and the shoes defining a tripod adapted for placement atop the compressor coil housing.

3. The HVAC compressor removal and installation apparatus according to claim 2, wherein each shoe is rigidly and immovably affixed to a distal end of the respective one of the legs.

4. The HVAC compressor removal and installation apparatus according to claim 2, wherein each said shoe further includes a padded liner attached to an inner face of each of the flanges.

5. The HVAC compressor removal and installation apparatus according to claim 1, wherein said plate has a winch cable passage disposed therethrough, said winch having a cable retractably extending therefrom, the cable passing through the winch cable passage.

6. The HVAC compressor removal and installation apparatus according to claim 5, wherein said winch is selected from the group consisting of hand-operated winches, electrically powered winches, hydraulically powered winches, and pneumatically powered winches.

7. The HVAC compressor removal and installation apparatus according to claim 1, wherein each of the groups of leg sockets comprises three leg sockets and the plurality of groups of leg sockets comprises three groups.

8. An HVAC compressor removal and installation apparatus, comprising:

an upper plate;

a winch mounted on the upper plate, the winch being adapted for lifting and lowering the compressor;

a plurality of legs extending from the upper plate, the plate and the legs defining a tripod; and an inverted L-shaped shoe extending from each of the legs, each of the shoes having an upper flange adapted for resting atop a cover of an HVAC coil housing, wherein the housing includes an inner rim, and a lower flange substantially orthogonal to the upper flange, the lower flange being adapted for placement within the inner rim of the HVAC coil housing, whereby the shoes bear against the coil housing and support the tripod legs atop the coil housing when the winch lifts the compressor for removal and lowers the compressor for installation.

9. The HVAC compressor removal and installation apparatus according to claim 8, further comprising a plurality of groups of leg sockets extending from said plate, said legs being removably insertable in the sockets, each of the leg sockets defining an angle between the socket and the plate, each of the groups defining a leg socket circle, each of the leg socket circles having a different diameter from one another, the leg sockets within each of the leg socket circles defining identical angles to one another.

10. The HVAC compressor removal and installation apparatus according to claim 9, wherein the plurality of groups of leg sockets comprises three groups, and each of the groups comprises three leg sockets.

11. The HVAC compressor removal and installation apparatus according to claim 8, wherein the plate has a winch cable passage disposed therethrough, said winch having a cable retractably extending from the winch and passing through the winch cable passage.

12. The HVAC compressor removal and installation apparatus according to claim 8, wherein said winch is selected from the group consisting of hand-operated winches, electrically powered winches, hydraulically powered winches, and pneumatically powered winches.

13. The HVAC compressor removal and installation apparatus according to claim 8, wherein each said shoe is rigidly and immovably affixed to a distal end of the respective one of the legs.

14. The HVAC compressor removal and installation apparatus according to claim 8, wherein each said shoe further includes a padded liner attached to the flanges.

15. An HVAC compressor removal and installation apparatus, comprising:

an upper plate having a winch cable passage disposed therethrough;

a winch disposed atop the plate, the winch being adapted for lifting and lowering the compressor;

a cable retractably extending from the winch and passing through the winch cable passage; and a plate support structure adapted for mounting atop a compressor coil housing, the upper plate being mounted on the plate support structure, said plate support structure comprises a plurality of legs extending from said plate, the legs and said plate defining a tripod, said plate support structure further comprises a plurality of groups of three leg sockets, said legs being removably inserted in the leg sockets, said groups defining mutually different tripod leg spans adapted for mounting on compressor coil housings of different diameter.

16. The HVAC compressor removal and installation apparatus according to claim 15, further comprising an inverted L-shaped shoe extending from each of said legs, each of the shoes having an upper flange adapted for resting atop a cover of the compressor coil housing and a lower flange substantially normal to the upper flange, the lower flange being adapted for bearing against an inner rim of the compressor coil housing.

17. The HVAC compressor removal and installation apparatus according to claim 16, wherein each said shoe further includes a padded liner attached to the flanges.

18. The HVAC compressor removal and installation apparatus according to claim 15, wherein said winch is selected from the group consisting of hand-operated winches, electrically powered winches, hydraulically powered winches, and pneumatically powered winches.

* * * * *